US007961889B2

(12) United States Patent
Kim et al.

(10) Patent No.: US 7,961,889 B2
(45) Date of Patent: Jun. 14, 2011

(54) APPARATUS AND METHOD FOR PROCESSING MULTI-CHANNEL AUDIO SIGNAL USING SPACE INFORMATION

(75) Inventors: Junghoe Kim, Seoul (KR); Sangchul Ko, Seoul (KR); Shihwa Lee, Seoul (KR); Eunmi Oh, Seoul (KR); Miao Lei, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1588 days.

(21) Appl. No.: 11/210,908

(22) Filed: Aug. 25, 2005

(65) Prior Publication Data

US 2006/0116886 A1 Jun. 1, 2006

(30) Foreign Application Priority Data

Dec. 1, 2004 (KR) ..... 10-2004-0099741

(51) Int. Cl.
*H04R 5/00* (2006.01)

(52) U.S. Cl. ..... 381/22; 381/23; 704/501; 704/503; 704/504; 704/200; 704/200.1; 704/203; 704/E19.005

(58) Field of Classification Search ..... 381/19–23, 381/1; 704/500–501, 200, 200.1, 203, 503–504, 704/E19.005

See application file for complete search history.

(56) References Cited

U.S. PATENT DOCUMENTS

| | | | | |
|---|---|---|---|---|
| 5,771,295 | A | 6/1998 | Waller, Jr. | 381/18 |
| 7,181,019 | B2 * | 2/2007 | Breebaart et al. | 381/23 |
| 7,394,903 | B2 * | 7/2008 | Herre et al. | 381/23 |
| 2003/0021423 | A1 * | 1/2003 | Wood | 381/18 |
| 2004/0091118 | A1 | 5/2004 | Griesinger | 381/20 |

FOREIGN PATENT DOCUMENTS

| | | |
|---|---|---|
| KR | 2001-0113782 | 12/2001 |
| WO | WO 03/090208 | 10/2003 |

OTHER PUBLICATIONS

David Griesinger, "Progress in 5-2-5 Matrix Systems", 103rd AES Convention, Sep. 26, 1997, pp. 1-34, XP007900011, New York, USA.

G. Stoll, "MPEG Audio Layer II: A Generic Coding Standard for Two and Multichannel Sound for DVB, DAB and Computer Multimedia", International Broadcasting Convention, 1995, Amsterdam, Netherlands, London, UK, IEE, UK, 1995, pp. 136-144, XP006528918, ISBN: 0-85296-644-X.

Chinese Office Action issued Jun. 5, 2009 in correspondence to Chinese Patent Application No. 200510123902.5.

* cited by examiner

*Primary Examiner* — Devona E Faulk
*Assistant Examiner* — Disler Paul
(74) *Attorney, Agent, or Firm* — Staas & Halsey LLP

(57) ABSTRACT

An apparatus for and a method of processing a multi-channel audio signal using space information. The apparatus includes: a main coding unit down mixing a multi-channel audio signal by applying space information to surround components included in the multi-channel audio signal, generating side information using the multi-channel audio signal or a stereo signal of a down-mixed result, coding the stereo signal and the side information, and transmitting the coded result as a coding signal; and a main decoding unit receiving the coding signal, decoding the stereo signal and the side information using the received coding signal, up mixing the decoded stereo signal using the decoded side information, and restoring the multi-channel audio signal.

24 Claims, 6 Drawing Sheets

APPARATUS AND METHOD FOR PROCESSING MULTI-CHANNEL AUDIO SIGNAL USING SPACE INFORMATION

CROSS-REFERENCE TO RELATED APPLICATION

This application claims the benefit of Korean Patent Application No. 2004-099741, filed on Dec. 1, 2004, in the Korean Intellectual Property Office, the disclosure of which is incorporated herein by reference.

BACKGROUND OF THE INVENTION

1. Field of the Invention

The present invention relates to signal processing using a moving picture experts group (MPEG) standard etc., and more particularly, to an apparatus and method for processing a multi-channel audio signal using space information.

2. Description of Related Art

In a conventional method and apparatus for processing an audio signal, spatial audio coding (SAC) for restoring surround components only using binaural cue coding (BCC) is used when restoring a multi-channel audio signal. SAC is disclosed in the paper "High-quality Parametric Spatial Audio Coding at Low Bitrates," $116^{th}$ AES convention, Preprint, p. 6072, and BCC is disclosed in the paper "Binaural Cue Coding Applied to Stereo and Multi-Channel Audio Compression," $112^{th}$ AES convention, Preprint, p. 5574.

In the above conventional method using SAC, surround components disappear when a stereo signal is down-mixed. In other words, a down-mixed stereo signal does not include the surround components. Thus, since side information having a large amount of data should be transmitted to restore the surround components when restoring a multi-channel audio signal, the conventional method has the drawback of a low channel transmission efficiency. Further, since the disappeared surround components are restored, the sound quality of the restored multi-channel audio signal is degraded.

BRIEF SUMMARY

An aspect of the present invention provides an apparatus for processing a multi-channel audio signal using space information, to code a multi-channel audio signal during restoration of surround components included in the multi-channel audio signal using space information and to decode the multi-channel audio signal.

An aspect of the present invention also provides a method of processing a multi-channel audio signal using space information, to code a multi-channel audio signal during restoration of surround components included in the multi-channel audio signal using space information and to decode the multi-channel audio signal.

According to an aspect of the present invention, there is provided an apparatus for processing a multi-channel audio signal using space information, the apparatus including: a main coding unit down mixing a multi-channel audio signal by applying space information to surround components included in the multi-channel audio signal, generating side information using the multi-channel audio signal or a stereo signal of a down-mixed result, coding the stereo signal and the side information to yield a coded result, and transmitting the coded result as a coding signal; and a main decoding unit receiving the coding signal, decoding the stereo signal and the side information using the received coding signal, up mixing the decoded stereo signal using the decoded side information, and restoring the multi-channel audio signal.

According to another aspect of the present invention, there is provided a method of processing a multi-channel audio signal using space information performed in an apparatus for processing a multi-channel audio signal having a main coding unit coding a multi-channel audio signal and a main decoding unit decoding the multi-channel audio signal from the coded multi-channel audio signal, the method including: down mixing a multi-channel audio signal by applying space information to surround components included in the multi-channel audio signal, generating side information using the multi-channel audio signal or a stereo signal of a down-mixed result, coding the stereo signal and the side information to yield a coded result, and transmitting the coded result as a coding signal to the main decoding unit; and receiving the coding signal transmitted from the main coding unit, decoding the stereo signal and the side information using the received coding signal, up mixing the decoded stereo signal using the decoded side information, and restoring the multi-channel audio signal.

According to another aspect of the present invention, there is provided a method of increasing compression efficiency, including: down mixing a multi-channel audio signal including surround components by applying space information to the surround components, generating side information using either the multi-channel audio signal or a stereo signal of a down-mixed result, coding the stereo signal and the side information to yield a coded result, and transmitting the coded result; and receiving the coding result, decoding the stereo signal and the side information from the received coding result, and up mixing the decoded stereo signal using the decoded side information so as to restore the multi-channel audio signal.

According to another aspect of the present invention, there is provided a multi-channel audio signal processing system, including: a coding unit down mixing a multi-channel audio signal including surround components by applying space information to the surround components, generating side information using either the multi-channel audio signal or a stereo signal of a down-mixed result, coding the stereo signal and the side information to yield a coded signal; and a decoding unit receiving the coded signal, decoding the received coded signal to obtain the stereo signal and the side information, and up mixing the decoded stereo signal using the decoded side information to yield the surround components.

Additional and/or other aspects and advantages of the present invention will be set forth in part in the description which follows and, in part, will be obvious from the description, or may be learned by practice of the invention.

BRIEF DESCRIPTION OF THE DRAWINGS

These and/or other aspects and advantages of the present invention will become apparent and more readily appreciated from the following detailed description, taken in conjunction with the accompanying drawings of which.

DETAILED DESCRIPTION OF EMBODIMENTS

Figure 1:
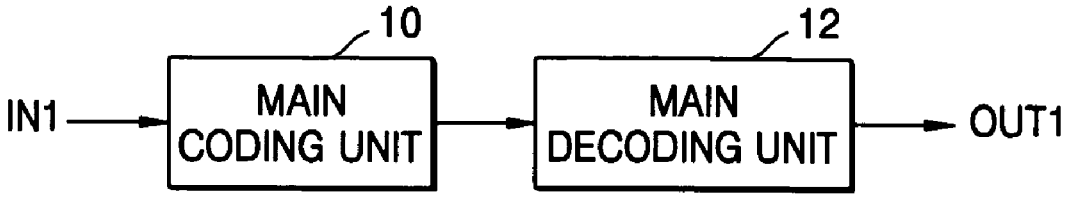
FIG. 1 is a block diagram of an apparatus for processing a multi-channel audio signal according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

FIG. 1 is a block diagram of an apparatus for processing a multi-channel audio signal according to an embodiment of the present invention. The apparatus of FIG. 1 includes a main coding unit 10 and a main decoding unit 12.

Figure 2:
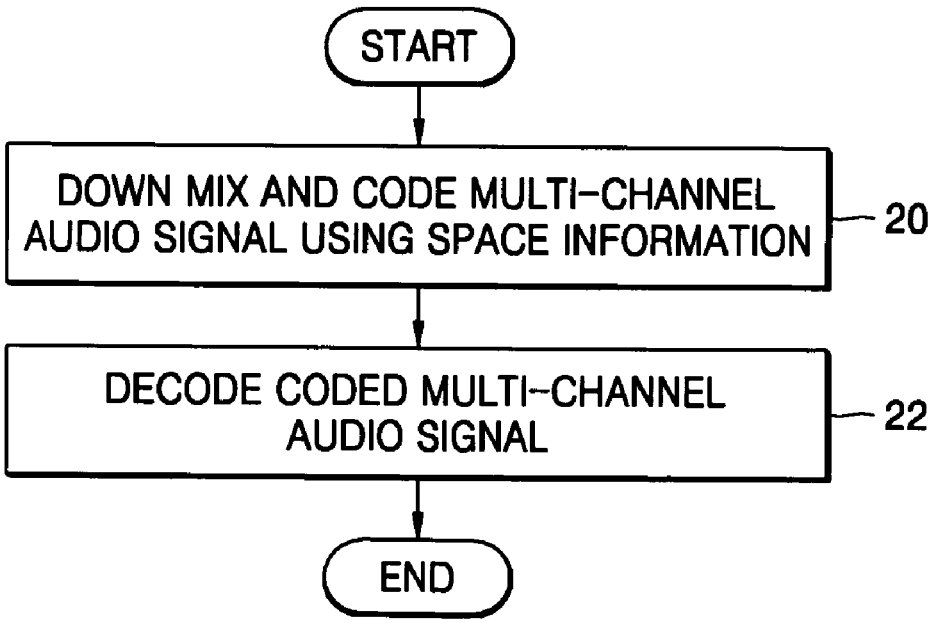
FIG. 2 is a flowchart illustrating a method of processing a multi-channel audio signal according to an embodiment of the present invention.

FIG. 2 is a flowchart illustrating a method of processing a multi-channel audio signal according to an embodiment of the present invention. The method of FIG. 2 includes coding a multi-channel audio signal (operation 20) and decoding the coded multi-channel audio signal (operation 22).

Referring to FIGS. 1 and 2, in operation 20, the main coding unit 10 of FIG. 1 down mixes a multi-channel audio signal by applying space information to surround components included in a multi-channel audio signal inputted through an input terminal IN1, generates side information using a stereo signal or a multi-channel audio signal, codes the stereo signal and the side information, and transmits a coded result as a coding signal to the main decoding unit 12. The stereo signal means the result of down-mixing the multi-channel audio signal. Space information is disclosed in the paper "Introduction to Head-Related Transfer Functions (HRTFs)", Representations of HRTFs in Time, Frequency, and Space, $107^{th}$ AES convention, Preprint, p. 50.

After operation 20, in operation 22, the main decoding unit 12 receives the coding signal transmitted from the main coding unit 10, decodes a stereo signal and side information using the received coding signal, up mixes the decoded stereo signal using the decoded side information, restores the multi-channel audio signal, and outputs the restored multi-channel audio signal through an output terminal OUT1.

Hereinafter, various exemplary configurations and operations of an apparatus for processing a multi-channel audio signal and a method of processing a multi-channel audio signal will be described with reference to the attached drawings.

Figure 3:
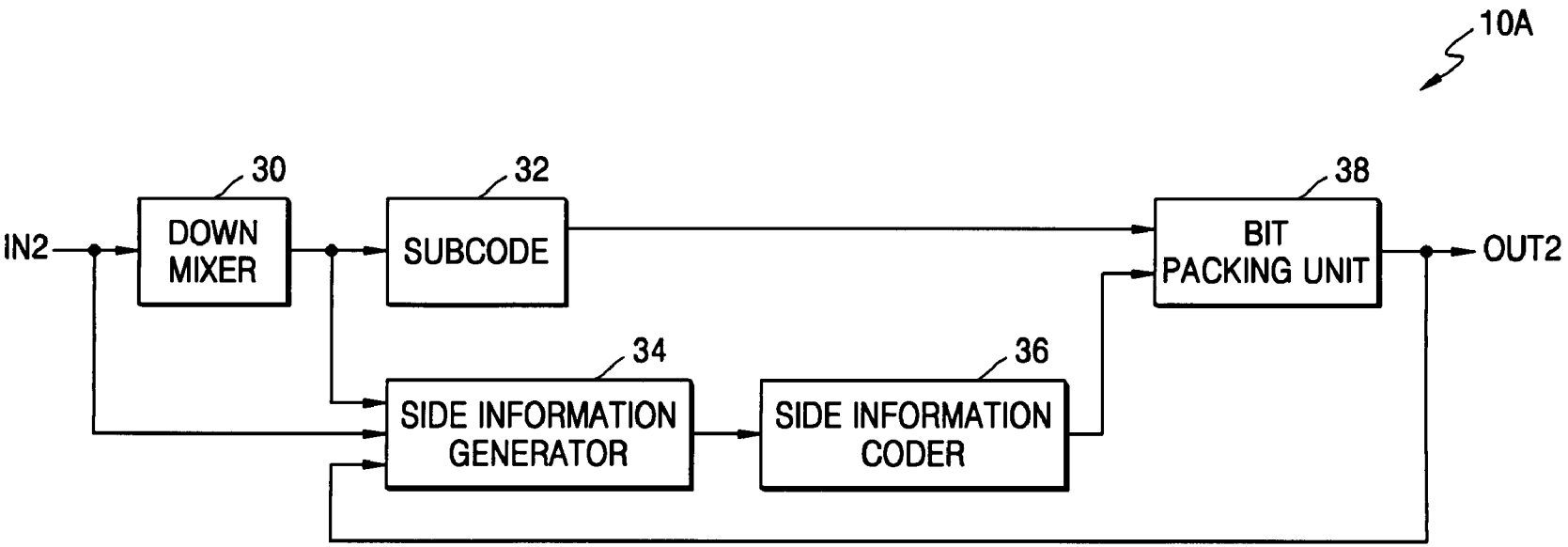
FIG. 3 is a block diagram of an example of the main coding unit shown in FIG. 1.

FIG. 3 is a block diagram of an example 10A of the main coding unit 10 shown in FIG. 1. The main coding unit 10A includes a down mixer 30, a subcoder 32, a side information generator 34, a side information coder 36, and a bit packing unit 38.

Figure 4:
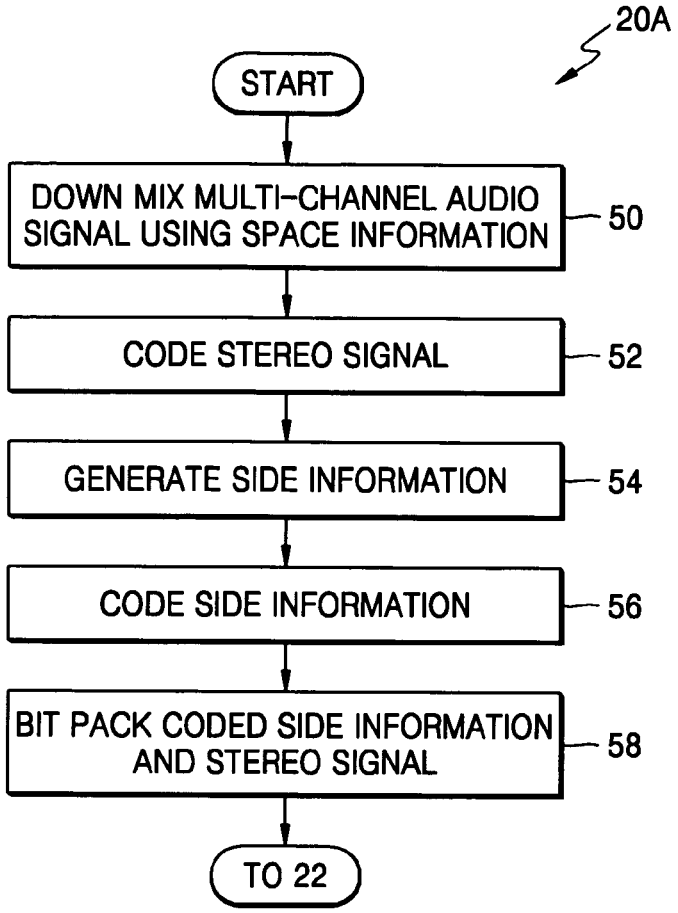
FIG. 4 is a flowchart illustrating an example of the operation 20 shown in FIG. 2.

FIG. 4 is a flowchart illustrating an example 20A of the operation 20 shown in FIG. 2. Operation 20A includes down-mixing a multi-channel audio signal using space information (operation 50), coding a stereo signal, generating side information, and coding side information (respective operations 52, 54, and 56), and bit-packing coded results (operation 58).

Referring to FIGS. 3 and 4, in operation 50, the down mixer 30 of FIG. 3 down mixes a multi-channel audio signal by applying space information to surround components included in the multi-channel audio signal inputted through an input terminal IN2, as shown in Equation 1, and outputs a down-mixed result as a stereo signal to the subcoder 32.

$$\begin{bmatrix} L_m \\ R_m \end{bmatrix} = W \sum_{i=1}^{N_f} \begin{bmatrix} F_{i0} \\ F_{i1} \end{bmatrix} + \sum_{j=1}^{N_s} [H_j] \begin{bmatrix} S_{j0} \\ S_{j1} \end{bmatrix} \tag{1}$$

where $L_m$ and $R_m$ are respectively a left component and a right component of a stereo signal obtained as a down-mixed result, W can be predetermined as a weighed value and varied, $F_{i0}$ and $F_{i1}$ are non-surround components among components included in a multi-channel audio signal inputted through an input terminal IN2, $S_{j0}$ and $S_{j1}$ are surround components among components included in the multi-channel audio signal, $N_f$ is the number of channels included in the non-surround components, $N_s$ is the number of channels included in the surround components, '0' of $F_{i0}$ and $S_{i0}$ is a left (L) [or right (R)] component, and '1' of $F_{i1}$ and $S_{i1}$ is a right (R) [or left (L)] component, and $H_j$ is a transfer function of a space filter that indicates space information.

Figure 5:
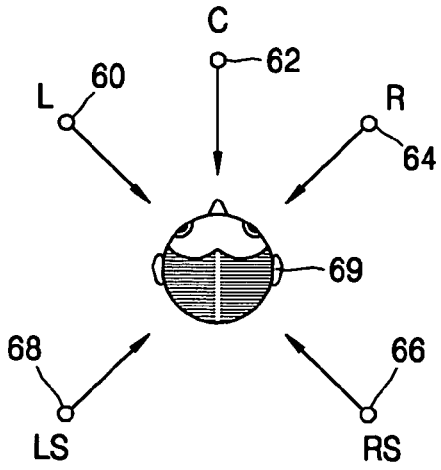
FIG. 5 illustrates a multi-channel audio signal processable by embodiments of the present invention.

FIG. 5 illustrates a multi-channel audio signal. Non-surround components 60, 62, and 64 and surround components 66 and 68 are included in the multi-channel audio signal. Here, reference numeral 69 denotes a listener.

As shown in FIG. 5, it is assumed that the non-surround components 60, 62, and 64 of the multi-channel audio signal consist of front components including a left (L) channel 60, a right (R) channel 64, and a center (C) channel 62 and the surround components included in the multi-channel audio signal consist of a right surround (RS) channel 66 and a left surround (LS) channel 68. In this case, Equation 1 can be simplified as shown in Equation 2.

$$\begin{bmatrix} L_m \\ R_m \end{bmatrix} = W \left\{ \begin{bmatrix} L \\ R \end{bmatrix} + \begin{bmatrix} C \\ C \end{bmatrix} \right\} + \begin{bmatrix} H_1 & H_2 \\ H_3 & H_4 \end{bmatrix} \begin{bmatrix} LS \\ RS \end{bmatrix} \tag{2}$$

where $$\begin{bmatrix} L \\ R \end{bmatrix} + \begin{bmatrix} C \\ C \end{bmatrix}$$

are the non-surround components 60, 62, and 64 included in the multi-channel audio signal, $$\begin{bmatrix} LS \\ RS \end{bmatrix}$$

are the surround components 66 and 68 included in the multi-channel audio signal, and $$\begin{bmatrix} H_1 & H_2 \\ H_3 & H_4 \end{bmatrix}$$

are space information $H_j$.

Figure 6:
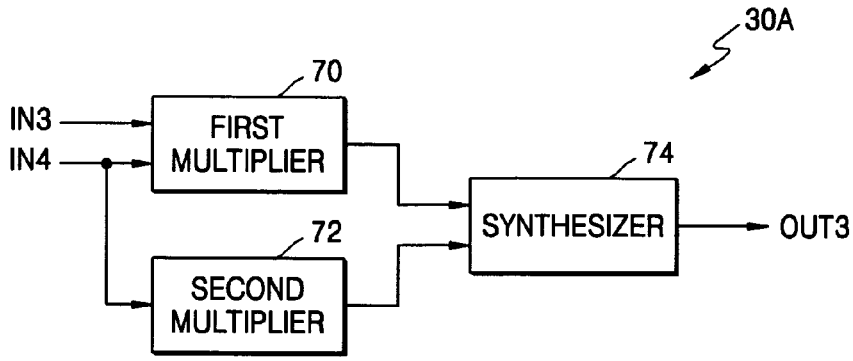
FIG. 6 is a block diagram of an example of the down mixer shown in FIG. 3.

FIG. 6 is a block diagram of an example 30A of the down mixer 30 shown in FIG. 3. The down mixer 30A includes first and second multipliers 70 and 72 and a synthesizer 74.

Referring to FIGS. 3, 4, and 6, the first multiplier 70 of the down mixer 30A multiplies a weighed value inputted through an input terminal IN3 by non-surround components included in the multi-channel audio signal inputted through an input terminal IN4, and outputs a multiplied result to the synthesizer 74. In this case, the second multiplier 72 multiplies surround components included in the multi-channel audio signal inputted through the input terminal IN4 by space information and outputs a multiplied result to the synthesizer 74. The synthesizer 74 synthesizes results multiplied by the first and second multipliers 70 and 72 and outputs a synthesized result as a stereo signal through an output terminal OUT3.

After operation 50, in operation 52, the subcoder 32 codes the stereo signal inputted from the down mixer 30 and outputs the coded stereo signal to the bit packing unit 38. For example, the subcoder 32 can code the stereo signal in a MP3 [or an MPEG-1 layer 3 or MPEG-2 layer 3], an MPEG4-advanced audio coding (AAC), or an MPEG4-bit sliced arithmetic coding (BSAC) format.

After operation 52, in operation 54, the side information generator 34 generates side information from the coding signal inputted from the bit packing unit 38 using the stereo signal inputted from the down mixer 30 or the multi-channel audio signal inputted through an input terminal IN2 and outputs the generated side information to the side information coder 36. Embodiments of the side information generator 34 and generation of side information performed in the side information generator 34 will be described later in detail.

After operation 54, in operation 56, the side information coder 36 codes the side information generated by the side information generator 34 and outputs the coded side information to the bit packing unit 38. To this end, the side information coder 36 can quantize the side information generated by the side information generator 34, compress a quantized result, and output a compressed result as coded side information to the bit packing unit 38.

Alternatively, unlike in FIG. 4, operation 52 may be simultaneously performed when operations 54 and 56 are performed or operation 52 may be performed after operations 54 and 55 are performed.

In operation 58, the bit packing unit 38 bit packs the side information coded by the side information coder 36 and stereo signal coded by the subcoder 32, transmits a bit-packed result as a coding signal to the main decoder 12 through an output terminal OUT2, and outputs the bit-packed result to the side information generator 34. For example, the bit packing unit 38 sequentially repeatedly performs the operations of storing the coded side information and the coded stereo signal, outputting the stored and coded side information, and then outputting the coded stereo signal. In other words, the bit packing unit 38 multiplexes the coded side information by the coded stereo signal and outputs a multiplexed result as a coding signal.

Figure 7:
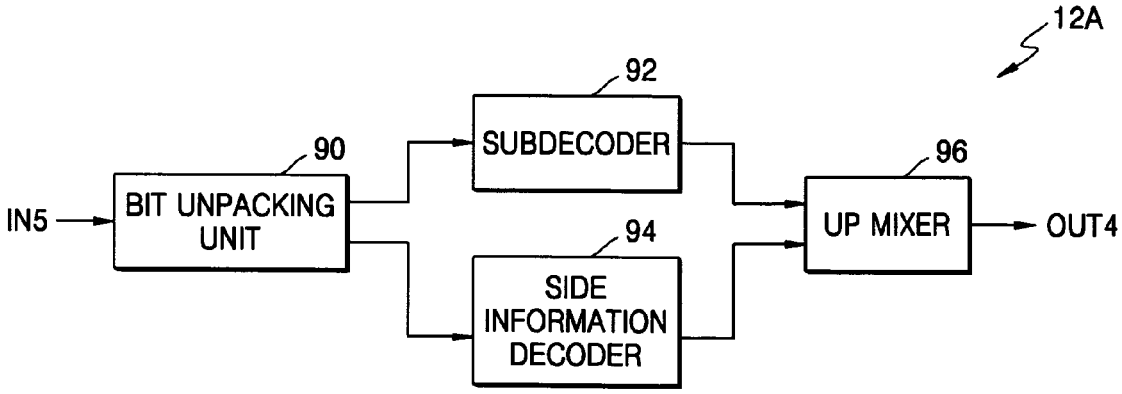
FIG. 7 is a block diagram of an example of the main decoding unit shown in FIG. 1.

FIG. 7 is a block diagram of an example 12A of the main decoding unit 12 shown in FIG. 1. The main decoding unit 12A includes a bit unpacking unit 90, a subdecoder 92, a side information decoder 94, and an up mixer 96.

Figure 8:
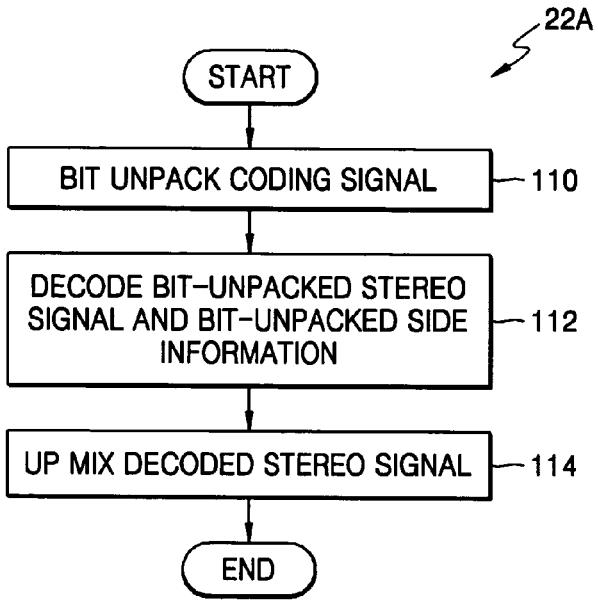
FIG. 8 is a flowchart illustrating an example of the operation 22 shown in FIG. 2.

FIG. 8 is a flowchart illustrating an example 22A of the operation 22 shown in FIG. 2. Operation 22A includes bit unpacking a coding signal (operation 110) and up-mixing a stereo signal using side information (respective operations 112 and 114).

Referring to FIGS. 3, 7, and 8, in operation 110, the bit unpacking unit 90 of FIG. 7 inputs a coding signal having a shape of a bit stream transmitted from the main coding unit 10 through an input terminal IN5, receives the coding signal, bit unpacks the received coding signal, outputs bit-unpacked side information to the side information decoder 94, and outputs the bit-unpacked stereo signal to the subdecoder 92. In other words, the bit unpacking unit 90 bit unpacks a result bit-unpacked by the bit packing unit 38 of FIG. 3.

After operation 110, in operation 112, the subdecoder 92 decodes the bit-unpacked stereo signal and outputs a decoded result to the up mixer 96, and the side information decoder 94 decodes the bit-unpacked side information and outputs a decoded result to the up mixer 96. As described above, when the side information coder 36 quantizes side information and compresses a quantized result, the side information decoder 94 restores side information, inverse quantizes a restored result, and outputs an inverse-quantized result as decoded side information to the up mixer 96.

After operation 112, in operation 114, the up mixer 96 up mixes the stereo signal decoded by the subdecoder 92 using side information decoded by the side information decoder 94 and outputs a up-mixed result as a restored multi-channel audio signal through an output terminal OUT4.

Figure 9:
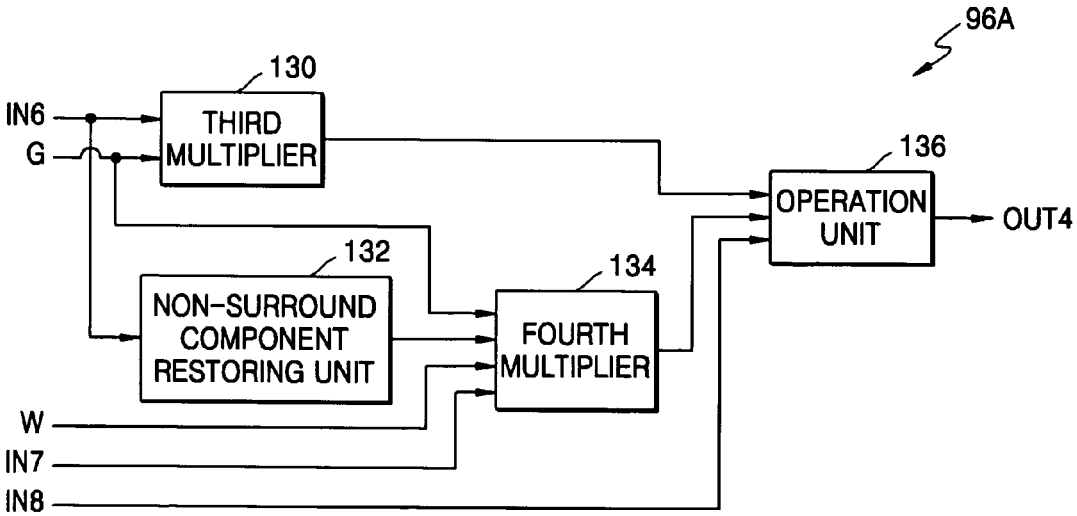
FIG. 9 is a block diagram of an example of the up mixer shown in FIG. 7.

FIG. 9 is a block diagram of an example 96A of the up mixer 96 shown in FIG. 7. The up mixer 96A includes respective third and fourth multipliers 130 and 134, a non-surround component restoring unit 132, and an operation unit 136.

Referring to FIGS. 3, 7, and 9, the third multiplier 130 of FIG. 9 multiplies the decoded stereo signal inputted from the subdecoder 92 through an input terminal IN6 by inverse space information G and outputs a multiplied result to the operation unit 136. Here, the inverse space information G is an inverse of space information, as shown in Equation 3 and may be changed according to an environment in which a multi-channel audio signal restored by the main decoding unit 12 is reproduced, or determined in advance.

$$G=H^{-1} \tag{3}$$

The non-surround component restoring unit 132 generates non-surround components from the decoded stereo signal inputted from the subdecoder 92 through an input terminal IN6 and outputs the generated non-surround components to the fourth multiplier 134. For example, when the down mixer 30 of FIG. 3 down mixes the multi-channel audio signal as shown in Equation 2, the non-surround component restoring unit 132 can generate the non-surround components using Equation 4.

$$\begin{aligned} L' &= L'_m \\ R' &= R'_m \\ C' &= \frac{L'_m + R'_m}{2} \end{aligned} \tag{4}$$

where L' is a left (channel) component among the non-surround components generated by the non-surround component restoring unit 132, R' is a right (channel) component among the non-surround components generated by the non-surround component restoring unit 132, C' is a center (channel) component among the non-surround components generated by the non-surround component restoring unit 132, $L_m'$ is a left (channel) component included in the stereo signal decoded by the subdecoder 92 of FIG. 7, and $R_m'$ is a right (channel) component included in the stereo signal decoded by the subdecoder 92.

The fourth multiplier 134 multiplies the non-surround components inputted from the non-surround component restoring unit 132 by the inverse space information G and a weighed value W and outputs a multiplied result to the operation unit 136. Here, the up mixer 96A of FIG. 9 may not include the non-surround component restoring unit 132. In this case, the non-surround components excluding surround components from the decoded stereo signal are directly inputted into the fourth multiplier 134 of the up mixer 96A from outside through an input terminal IN7.

The operation unit 136 restores the multi-channel audio signal using the results multiplied by the third and fourth multipliers 130 and 134 and the decoded side information inputted from the side information decoder 94 through an input terminal IN8 and outputs the restored multi-channel audio signal through an output terminal OUT4.

Figure 10:
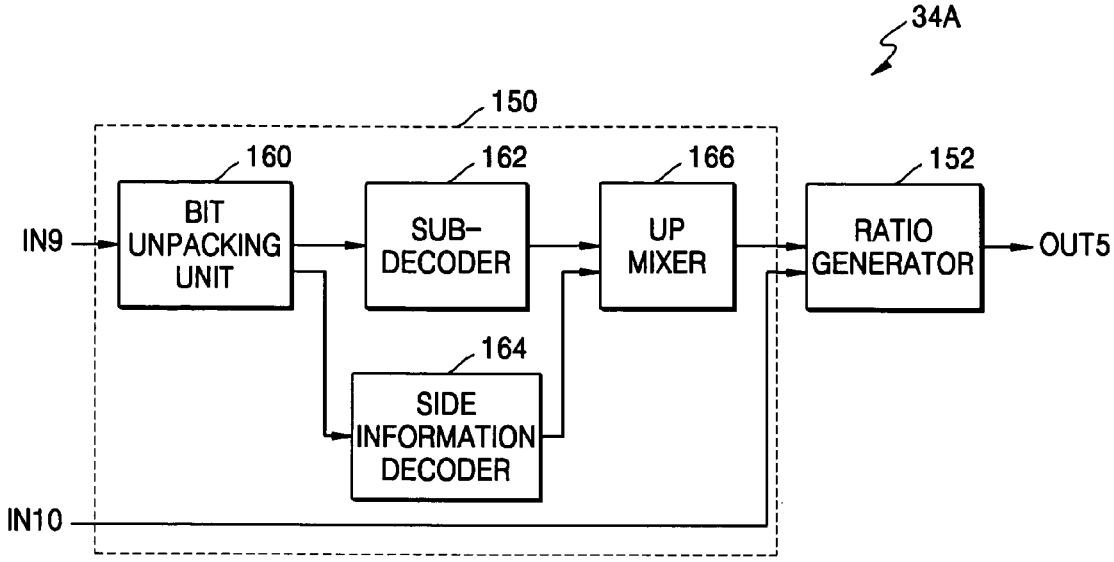
FIG. 10 is a block diagram of an example of the side information generator shown in FIG. 3.

FIG. 10 is a block diagram of an example 34A of the side information generator 34 shown in FIG. 3. The side information generator 34A includes a surround component restoring unit 150 and a ratio generator 152.

The surround component restoring unit 150 restores surround components from the coding signal inputted from the bit packing unit 38 through an input terminal IN9 and outputs the restored surround components to the ratio generator 152.

To this end, for example, the surround component restoring unit 150 is shown to optionally include a bit unpacking unit 160, a subdecoder 162, a side information decoder 164, and an up mixer 166 as shown in FIG. 10. Here, the bit unpacking unit 160, the subdecoder 162, the side information decoder 164, and the up mixer 166 perform the same functions as the bit unpacking unit 90, the subdecoder 92, the side information decoder 94, and the up mixer 96 of FIG. 7, and thus, a detailed description thereof will be omitted.

According to an embodiment of the present invention, the ratio generator 152 generates the ratio of the restored surround components outputted from the surround component restoring unit 150 to the multi-channel audio signal inputted through an input terminal IN10 and outputs the generated ratio as side information through an output terminal OUT5 to the side information decoder 36. For example, when the down mixer 30 shown in FIG. 3 down mixes the multi-channel audio signal as shown in Equation 2 described previously, the ratio generator 152 can generate side information using Equation 5.

$$SI = \left\{ \frac{LS'}{LS}, \frac{RS'}{RS} \right\} \tag{5}$$

where SI is side information generated by the ratio generator 152, LS' is a left component among the surround components included in the multi-channel audio signal restored by the surround component restoring unit 150, for example, outputted from the up mixer 166, and RS' is a right component among the surround components included in the restored multi-channel audio signal outputted from the up mixer 166.

The ratio of side information generated by the ratio generator 152 as shown in Equation 5 may be a power ratio or both a power ratio and a phase ratio. For example, the ratio generator 152 may generate side information using Equation 6 or 7

$$SI = \left\{ \frac{|LS'|}{|LS|}, \frac{|RS'|}{|RS|} \right\} \tag{6}$$

where |LS'| is a phase of LS', |LS| is a power of LS, |RS'| is a power of RS', and |RS| is a power of RS.

$$SI = \left\{ \frac{|LS'|\angle LS'}{|LS|\angle LS}, \frac{|RS'|\angle RS'}{|RS|\angle RS} \right\} \tag{7}$$

where ∠LS' is a phase of LS', ∠LS is a phase of LS, ∠RS' is a phase of RS', and ∠RS is a phase of RS.

Alternatively, the ratio generator 152 generates the ratio of the restored surround components outputted from the surround component restoring unit 150 and the stereo signal inputted from the down mixer 30 through an input terminal IN10 and outputs the generated ratio as the side information to the side information decoder 36 through an output terminal OUT5. For example, when the down mixer 30 of FIG. 3 down mixes the multi-channel audio signal as shown in Equation 2, the ratio generator 152 can generate side information using Equation 8.

$$SI = \left\{ \frac{LS'}{L_m}, \frac{RS'}{R_m} \right\} \tag{8}$$

The ratio of the side information generated by the ratio generator 152 as shown in Equation 8 may be a power ratio or both a power ratio and a phase ratio. For example, the ratio generator 152 can generate the side information as shown in Equation 9 or 10

$$SI = \left\{ \frac{|LS'|}{|L_m|}, \frac{|RS'|}{|R_m|} \right\} \tag{9}$$

where $|L_m|$ is a power of $L_m$ and $|R_m|$ is a power of $R_m$.

$$SI = \left\{ \frac{|LS'|\angle LS'}{|L_m|\angle L_m}, \frac{|RS'|\angle RS'}{|R_m|\angle R_m} \right\} \tag{10}$$

where $\angle L_m$ is a phase of $L_m$ and $\angle R_m$ is a phase of $R_m$.

As described above, when the ratio generator 152 shown in Equation 10 generates the side information using the ratio of the restored surround components and the multi-channel audio signal, the structure and operation of the operation unit 136 of FIG. 9 will now be described.

Figure 11:
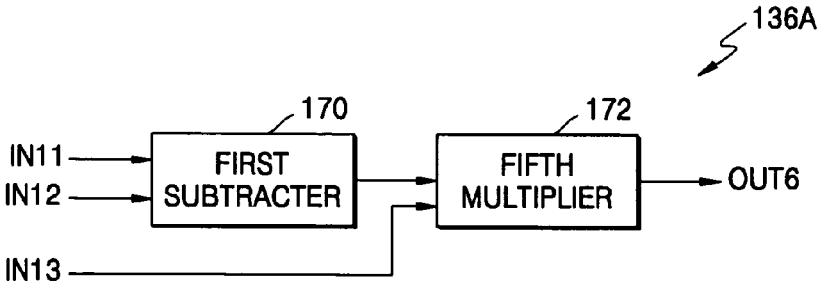
FIG. 11 is a block diagram of an example of the operation unit shown in FIG. 9.

FIG. 11 is a block diagram of an example 136A of the operation unit 136 shown in FIG. 9. The operation unit 136A includes a first subtracter 170 and a fifth multiplier 172.

Referring to FIGS. 3 and 9-11, the first subtracter 170 subtracts a result multiplied by the fourth multiplier 134 inputted through an input terminal IN12 from a result multiplied by the third multiplier 130 of FIG. 9 inputted through an input terminal IN11 and outputs a subtracted result to the fifth multiplier 172. In this case, the fifth multiplier 172 multiplies the subtracted result inputted from the first subtracter 170 by the side information decoded by the side information decoder 94 inputted through an input terminal IN13 and outputs a multiplied result as a restored multi-channel audio signal through an output terminal OUT6.

For example, when the down mixer 30 of FIG. 3 down mixes the multi-channel audio signal as shown in Equation 2, surround components of the restored multi-channel audio signal outputted from the fifth multiplier 172 can be shown as Equation 11

$$\begin{bmatrix} LS''' \\ RS''' \end{bmatrix} = SI' \begin{bmatrix} LS'' \\ RS'' \end{bmatrix} \tag{11}$$

where $$\begin{bmatrix} LS''' \\ RS''' \end{bmatrix}$$

is the surround components of the restored multi-channel audio signal outputted from the fifth multiplier 172, SI' is the decoded side information, $$\begin{bmatrix} LS'' \\ RS'' \end{bmatrix}$$

is the subtracted result outputted from the first subtracter 170 and can be shown as Equation 12

$$\begin{bmatrix} LS'' \\ RS'' \end{bmatrix} = G \begin{bmatrix} L'_m \\ R'_m \end{bmatrix} - GW \left\{ \begin{bmatrix} L' \\ R' \end{bmatrix} + \begin{bmatrix} C' \\ C' \end{bmatrix} \right\} \tag{12}$$

where $$\begin{bmatrix} L'_m \\ R'_m \end{bmatrix}$$

is the decoded stereo signal inputted from the subdecoder 92 to the third multiplier 130 through an input terminal IN6.

When the ratio generator 152 of FIG. 10 generates the side information using the ratio of the restored surround components and the stereo signal inputted from the down mixer 30, the structure and operation of the operation unit 136 of FIG. 9 will now be described.

Figure 12:
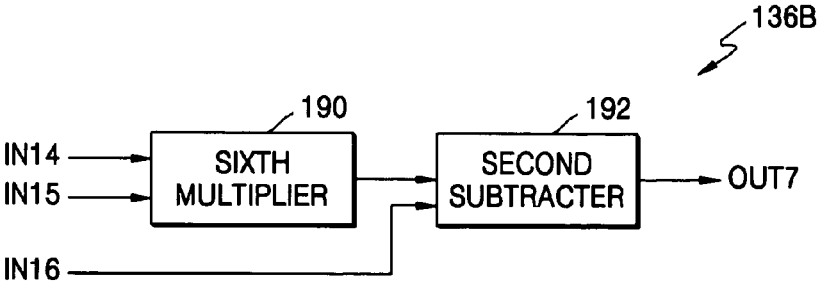
FIG. 12 is a block diagram of another example of the operation unit shown in FIG. 9.

FIG. 12 is a block diagram of an example of 136B of the operation unit 136 shown in FIG. 9. The operation unit 136B includes a sixth multiplier 190 and a second subtracter 192.

Referring to FIGS. 3, 9, 10, and 12, the sixth multiplier 190 multiplies a result multiplied by the third multiplier 130 inputted through an input terminal IN14 by a result multiplied by the side information decoded by the side information decoder 94 inputted through an input terminal IN15 and outputs a multiplied result to the second subtracter 192. The second subtracter 192 subtracts the result multiplied by the fourth multiplier 134 inputted through an input terminal IN16 from the result multiplied by the sixth multiplier 190 and outputs a subtracted result as a restored multi-channel audio signal through an output terminal OUT7.

For example, when the down mixer 30 of FIG. 3 down mixes the multi-channel audio signal as shown in Equation 2, surround components of the restored multi-channel audio signal, that is, the subtraction result outputted from the second subtracter 192 can be shown as Equation 13

$$\begin{bmatrix} LS''' \\ RS''' \end{bmatrix} = G \times SI' \times \begin{bmatrix} L'_m \\ R'_m \end{bmatrix} - G \times W \times \begin{bmatrix} LS'' \\ RS'' \end{bmatrix} \tag{13}$$

where $$\begin{bmatrix} LS''' \\ RS''' \end{bmatrix}$$

is the surround components of the restored multi-channel audio signal outputted from the second subtracter 192, $$G \times SI' \times \begin{bmatrix} L'_m \\ R'_m \end{bmatrix}$$

is the result multiplied by the sixth multiplier 190, $$G \times W \times \begin{bmatrix} LS'' \\ RS'' \end{bmatrix}$$

is the result multiplied by the fourth multiplier 134, and $$\begin{bmatrix} LS'' \\ RS'' \end{bmatrix}$$

is the same as that of FIG. 12.

In the apparatus and method for processing a multi-channel audio signal using space information according to the above-described embodiments of the present invention, after the non-surround components are restored using the restored stereo signal, the surround components are restored using the restored non-surround components. Thus, in restoring the multi-channel audio signal, crosstalk can be prevented from occurring when the surround components and the non-surround components are restored together.

In the apparatus and method for processing the multi-channel audio signal using space information according to the above-described embodiments of the present invention, since space information is included in a down-mixed stereo signal and the side information is generated based on user's perceptual characteristics, for example, using a power ratio and a phase ratio, the multi-channel audio signal can be up-mixed only using a small amount of side information, the amount of data of the side information to be transmitted from the main coding unit 10 to the main decoding unit 12 can be reduced, a compression efficiency of a channel, that is, a transmission efficiency, can be maximized, since surround components are included in the stereo signal unlike in conventional spatial audio coding (SAC), a multi-channel effect can be obtained only using a stereo speaker through a restored multi-channel audio signal so that a realistic sound quality can be provided, conventional binaural cue coding (BCC) can be replaced, since the audio signal is decoded using inverse space information effectively expressed in consideration of the position of a speaker in a multi-channel audio system, an optimum sound quality can be provided and crosstalk can be prevented from occurring.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. An apparatus, including at least one processing device, for processing a multi-channel audio signal using space information, comprising:

a main coding unit, using the at least one processing device, down mixing a multi-channel audio signal by applying space information to surround components included in the multi-channel audio signal, generating side information using the multi-channel audio signal or a stereo signal of a down-mixed result, coding the stereo signal and the side information to yield a coded result, and transmitting the coded result as a coding signal; and a main decoding unit receiving the coding signal, decoding the stereo signal and the side information which corresponds to the space information including a power ratio between channels, from the received coding signal, up mixing the decoded stereo signal using the decoded side information and an inverse head-related transfer function (HRTF) information, and restoring the multi-channel audio signal.

2. The apparatus of claim 1, wherein the main coding unit includes:

a down mixer down-mixing the multi-channel audio signal by applying the space information to surround components of the multi-channel audio signal and outputting the down-mixed result as the stereo signal;

a subcoder coding the stereo signal;

a side information generator generating the side information from the coding signal using the stereo signal or the multi-channel audio signal;

a side information coder coding the side information; and a bit packing unit bit-packing the coded side information and the coded stereo signal and transmitting the bit-packed result as the coding signal to the main decoding unit.

3. The apparatus of claim 2, wherein the down mixer includes:

a first multiplier multiplying non-surround components excluding the surround components from the multi-channel audio signal by a weighed value;

a second multiplier multiplying the surround components by the space information; and a synthesizer synthesizing the results multiplied by the first and second multipliers and outputting the synthesized result as the stereo signal.

4. The apparatus of claim 2, wherein the main decoding unit includes:

a bit unpacking unit receiving the coding signal, bit-unpacking the received coding signal and outputting bit-unpacked side information and bit-unpacked stereo signal;

a subdecoder decoding the bit-unpacked stereo signal;

a side information decoder decoding the bit-unpacked side information; and a up mixer up-mixing the decoded stereo signal using the decoded side information and outputting the up-mixed result as the restored multi-channel audio signal.

5. The apparatus of claim 4, wherein the up mixer includes:

a first multiplier multiplying the decoded stereo signal by inverse space information;

a second multiplier multiplying the non-surround components excluding the surround components from the decoded stereo signal by the inverse space information and the weighed value; and an operation unit restoring the multi-channel audio signal using the results multiplied by the first and second multipliers and the decoded side information.

6. The apparatus of claim 5, wherein the side information generator includes:

a surround component restoring unit restoring the surround components from the coding signal; and a ratio generator generating a ratio of the restored surround components to the multi-channel audio signal and outputting the generated ratio as the side information.

7. The apparatus of claim 6, wherein the operation unit includes:

a first subtracter subtracting the result multiplied by the second multiplier from the result multiplied by the first multiplier; and a third multiplier multiplying the subtracted result inputted from the first subtracter by the side information and outputting the multiplied result as the restored multi-channel audio signal.

8. The apparatus of claim 5, wherein the side information generator includes:

a surround component restoring unit restoring the surround components from the coding signal; and a ratio generator generating a ratio of the restored surround components to the stereo signal and outputting the generated ratio as the side information.

9. The apparatus of claim 8, wherein the operation unit includes:

a fourth multiplier multiplying the result multiplied by the first multiplier by the side information; and a second subtracter subtracting the result multiplied by the second multiplier from the result multiplied by the fourth multiplier and outputting the subtracted result as the restored multi-channel audio signal.

10. The apparatus of claim 6, wherein the ratio generated by the ratio generator includes a power ratio.

11. The apparatus of claim 8, wherein the ratio generated by the ratio generator includes a power ratio.

12. The apparatus of claim 10, wherein the ratio generated by the ratio generator further includes a phase ratio.

13. The apparatus of claim 11, wherein the ratio generated by the ratio generator further includes a phase ratio.

14. The apparatus of claim 5, wherein the up mixer further includes a non-surround component restoring unit generating the non-surround components from the decoded stereo signal.

15. The apparatus of claim 5, wherein the inverse space information is changed according an environment in which the restored multi-channel audio signal is reproduced.

16. A method of processing a multi-channel audio signal using space information performed in an apparatus for processing a multi-channel audio signal having a main coding unit coding a multi-channel audio signal and a main decoding unit decoding the multi-channel audio signal from the coded multi-channel audio signal, the method comprising:

down mixing a multi-channel audio signal by applying space information to surround components included in the multi-channel audio signal, generating side information using the multi-channel audio signal or a stereo signal of a down-mixed result, coding the stereo signal and the side information to yield a coded result, and transmitting the coded result as a coding signal to the main decoding unit; and receiving the coding signal transmitted from the main coding unit, decoding the stereo signal and the side information which corresponds to the space information including a power ratio between channels, from the received coding signal, up mixing the decoded stereo signal using the decoded side information and an inverse head-related transfer function (HRTF) information, and restoring the multi-channel audio signal.

17. The method of claim 16, wherein the down-mixing includes:

down mixing the multi-channel audio signal by applying the space information to surround components of the multi-channel audio signal and determining the down-mixed result as the stereo signal;

coding the stereo signal;

generating the side information from the coding signal using the stereo signal or the multi-channel audio signal;

coding the side information; and bit packing the coded side information and the coded stereo signal and transmitting the bit-packed result as the coding signal to the main decoding unit.

18. The method of claim 17, wherein the receiving includes:

receiving the coding signal, bit-unpacking the received coding signal, and obtaining bit-unpacked side information and bit-unpacked stereo signal;

decoding the bit-unpacked stereo signal and decoding the bit-unpacked side information; and up mixing the decoded stereo signal using the decoded side information and determining the up-mixed result as the restored multi-channel audio signal.

19. A method of increasing compression efficiency, comprising:

down mixing a multi-channel audio signal including surround components by applying space information to the surround components, generating side information using either the multi-channel audio signal or a stereo signal of a down-mixed result, coding the stereo signal and the side information to yield a coded result, and transmitting the coded result; and receiving the coding result, decoding the stereo signal and the side information which corresponds to the space information including a power ratio between channels from the received coding result, and up mixing the decoded stereo signal using the decoded side information and an inverse head-related transfer function (HRTF) information so as to restore the multi-channel audio signal.

20. A multi-channel audio signal processing system, including at least one processing device, comprising:

a coding unit, using the at least one processing device, down mixing a multi-channel audio signal including surround components by applying space information to the surround components, generating side information using either the multi-channel audio signal or a stereo signal of a down-mixed result, coding the stereo signal and the side information to yield a coded signal; and a decoding unit receiving the coded signal, decoding the received coded signal to obtain the stereo signal and the side information which corresponds to the space information including a power ratio between channels, from the received coded signal, and up mixing the decoded stereo signal using the decoded side information and an inverse head-related transfer function (HRTF) information to yield the surround components.

21. A method of generating a multi-channel audio signal using space information, comprising:

receiving a coding signal, and decoding a stereo signal and side information, which corresponds to the space information including a power ratio between channels, from the received coding signal; and up mixing the decoded stereo signal using the decoded side information and an inverse head-related transfer function (HRTF) information, and restoring the multi-channel audio signal.

22. The method of claim 21, wherein the receiving of the coding signal further comprises subdecoding the coding signal to generate the stereo signal.

23. The method of claim 22, wherein the receiving of the coding signal further comprises side information decoding the coding signal, separate from the subdecoding of the coding signal to generate the stereo signal, to decode side information from the coding signal, and wherein the up mixing of the decoded stereo signal further comprises restoring non-surround components from the stereo signal and restoring the multi-channel audio signal based on the restored non-surround components, the stereo signal, and the decoded side information.

24. The method of claim 23, wherein the up mixing further comprises individually multiplying the stereo signal by the inverse HRTF information and the non-surround components by the inverse HRTF information.

* * * * *